US005791320A

United States Patent [19]

Haban

[11] Patent Number: 5,791,320

[45] Date of Patent: Aug. 11, 1998

[54] ENGINE IGNITION SYSTEM

[76] Inventor: Eugene Haban, 6913 - C Acco St., Montebello, Calif. 90640

[21] Appl. No.: 780,404

[22] Filed: Jan. 9, 1997

[51] Int. Cl.[6] ..... F02P 15/08; H01T 13/22

[52] U.S. Cl. ..... 123/640; 123/169 EL; 313/128

[58] Field of Search ..... 123/640, 637, 123/169 EL, 169 MG; 313/128, 140, 141

[56] References Cited

U.S. PATENT DOCUMENTS 1,033,449 7/1912 Murray ..... 313/128
1,191,429 7/1916 Jensen ..... 123/169 MG
1,363,904 12/1920 Nicholson ..... 123/169 MG
2,457,973 1/1949 Blau ..... 313/128

*Primary Examiner*—Willis R. Wolfe
*Assistant Examiner*—Hieu T. Vo
*Attorney, Agent, or Firm*—Erik M. Arnhem

[57] ABSTRACT

An engine ignition system includes spark plugs having two high voltage electrodes connected to separate high voltage sources. Should one voltage source fail, the engine will continue to fire with sparks generated by the other high voltage source. The invention has special applicability to single engine aircraft.

3 Claims, 1 Drawing Sheet

ENGINE IGNITION SYSTEM

BACKGROUND OF THE INVENTION

1. Field of the Invention

This invention relates to an engine ignition system, and particularly to an ignition system having two separate voltage sources connected to each spark plug on the engine, whereby each spark plug generates two separate sparks in the associated combustion chamber. The voltage sources are redundant, so that inadvertant failure of either voltage source does not significantly impair the operability of any spark plug on the engine.

2. Prior Art Developments

Many spark-ignition aircraft engines use magnetos as the high voltage source for delivering current to the engine spark plugs. In event of failure of the magneto on the associated electrical circuitry, the spark plugs fail to generate ignition sparks in the combustion chambers, so that the engine becomes inoperative. In the case of a single engine aircraft, engine failure results in an emergency. The present invention is concerned with an ignition system designed to avoid engine failure resulting from electric circuit failure in the ignition system.

SUMMARY OF THE INVENTION

The present invention relates to an engine ignition system that includes two separate high voltage sources connected to each spark plug on the engine. One of the high voltage sources comprises an engine-driven magneto. The other high voltage source comprises a battery and an electric ignition circuit of the type used with automotive engines.

Each spark plug comprises an insulator body seated in a metal shell, and two separate electrodes extending through the insulator body. A first one of the electrodes is electrically connected to the magneto voltage source, and the other electrode is electrically connected to the battery voltage source. In the event of failure of either voltage source, the other voltage will be unaffected so that the engine will continue to fire.

The invention has particular usefulness in aircraft engines, where engine failure can be catastrophic. By using the invention in an aircraft environment it becomes possible to prevent catastrophic engine failures associated with ignition system malfunction.

THE DRAWINGS

DESCRIPTION OF A PREFERRED EMBODIMENT OF THE INVENTION

Figure 1:
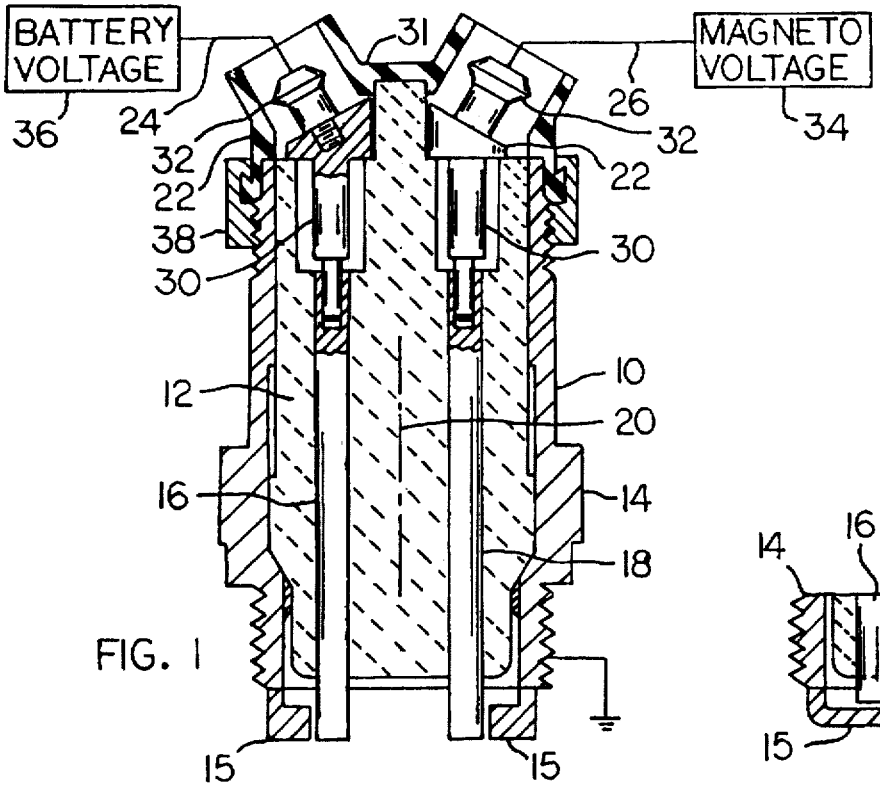
FIG. 1 is a sectional view taken through a spark plug constructed according to the invention.

FIG. 1 shows one illustrative spark plug on an engine equipped with a spark-ignition system of the present invention. The other spark plugs on the engine are similarly constructed.

As shown in FIG. 1, spark plug 10 comprises a ceramic insulator body 12 seated in a metallic (steel) shell 14 that is equipped with two ground electrodes 15. The shell is externally threaded for screwing into an end wall of the engine combustion chamber. Two parallel high voltage electrodes 16 and 18 extend longitudinally through insulator body 12 parallel to the longitudinal central axis 20 of the insulator body. As viewed in FIG. 2, the electrodes are equidistant from central axis.

Each electrode 16 or 18 has a conductive terminal 22 adapted to be electrically connected to a lead wire. FIG. 1 schematically references the separate lead wires with numerals 24 and 26. Terminals 22, 22 are similarly constructed. Each terminal comprises a machined metal element 30 having a press fit in a socket in the end of the associated electrode, whereby the machined element is clamped against an end surface of insulator body 12. Each terminal further comprises a metallic plug element 32 screwed into a threaded hole in element 30.

The respective plug elements 32, 32 diverge away from the insulator body central axis 20 in opposite directions, to minimize electrical bridging from one terminal to the other terminal, while permitting each terminal to be adequately sized for its electrical function.

A dielectric boot 31 fits around the terminals 22, 22 to minimize electrical losses or short circuits from atmospheric moisture or condensation. As shown, the boot has separate dielectric sleeves surrounding each terminal. The boot can be held in place by a nut 38 threaded onto external threads on the metal shell.

The terminal associated with electrode 18 is connectable to a cyclic high voltage source 34 generated by an engine-driven magneto. This high voltage source is commonly used on aircraft engines.

The terminal associated with electrode 16 is connectable to a cyclic high voltage source 36 generated by a battery. This high voltage source can include componentry used in electronic ignition systems on automotive engines. Typically the system will include a spark plug coil, electronic advance responsive to engine speed, electronic advance responsive to engine load, a magnetic shaft speed sensor for measuring engine speed, and a microprocessor for analyzing certain sensor inputs to determine the appropriate spark advance.

The two separate voltage sources 34 and 36 operate in parallel, although not necessarily in exact synchronism. For example, the spark generated by electrode 16 can be slightly ahead, or slightly behind, the spark generated by electrode 18. By separating the two sparks by a few engine degrees, it may be possible to improve the combustion efficiency slightly, since the second spark can be made to ignite some gases or vapors not fully combusted as a result of the first spark.

Nevertheless, the principal advantage and purpose of the invention can be realized by intentionally synchronizing the sparks, i.e. by having both sparks occur at the same instant, e.g. twelve degrees before top dead center or some other port determined by the microprocessor or control in the magneto circuit. Spark synchronization is not considered critical to practice of the invention.

The principal advantage or purpose, of the invention is to achieve spark ignition redundancy, whereby failure of either voltage source 34 or 36 does not result in engine failure. The engine will fire, even when one or the other voltage source becomes inoperative for any reason.

Figure 3:
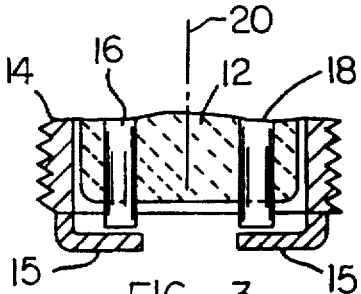
FIG. 3 is a fragmentary sectional view taken in the same direction as FIG. 1, but showing another spark plug embodying the invention.
Figure 2:
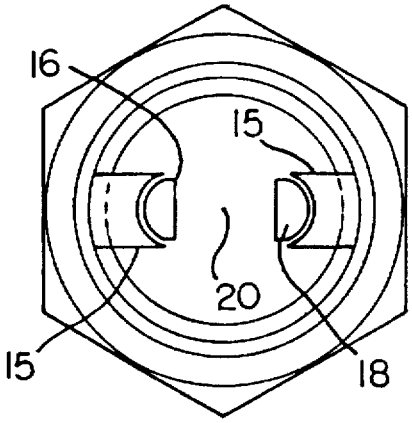
FIG. 2 is a bottom view of the spark plug depicted in FIG. 1.
Figure 4:
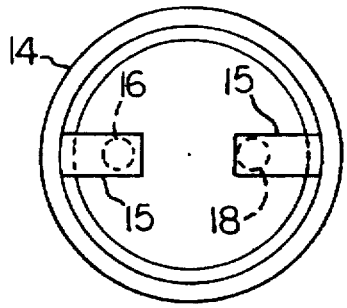
FIG. 4 is a bottom view of the FIG. 3 spark plug.

The physical orientation of the high voltage electrodes and ground electrodes can be varied while still practicing the invention. As shown in FIGS. 1 and 2, the ground electrodes 15 concave edge surfaces 17 registering with convex arcuate side surfaces on the high voltage electrodes 16 and 18, whereby the sparks travel radially. As shown in FIGS. 3 and 4, the ground electrodes have flat side surfaces registering with flat end surfaces on the high voltage electrodes, whereby the sparks travel axially across the electrode gap, i.e. parallel to central axis 20.

The high voltage electrodes in FIGS. 1 and 2 have D cross-sections. Such a cross section is advantageous in that the cross section can be reasonably small while still providing a reasonably sized convex surface facing the ground electrode. The high voltage electrodes of FIGS. 1 and 2 are advantageous in that a relatively large axial electrode surface is presented to the ground electrode.

The high voltage electrodes in FIGS. 3 and 4 are advantageous in that they have relatively short axial penetration dimensions into the combustion chamber. Either electrode configuration can be used in practice of the invention.

In a certain sense, the single spark plug of FIG. 1 (or FIG. 3) is the equivalent of two separate spark plugs (because the single plug uses separate voltage sources to generate two separate sparks). The advantage of one spark plug, over two separate plugs, is that it requires less space. In an engine, space for the spark plug is quite limited because the valves and fuel injector take up most of the available space.

The drawings show particular forms that the invention can take. However, the invention can be practiced in various forms and configurations.

What is claimed is:

1. An engine ignition system comprising a spark plug having first and second high tension electrodes, and a grounded shell; a first voltage source connected to said first electrode, and a second voltage source connected to said second electrode, whereby failure of either voltage source will not disable the ignition system; said grounded shell having two ground electrodes proximate to said first and second high tension electrodes; each of said first and second electrodes having a D-shaped cross section that present a convex curved surface to the associated ground electrode.

2. The engine ignition system of claim 1, wherein each, said ground electrode has an arcuate concave surface facing the convex curved surface on the associated high tension electrode.

3. An engine ignition system comprising a spark plug that includes a grounded shell having a central longitudinal axis, an insulator body seated in said shell, a first high tension electrode extending through said insulator body parallel to said central axis, and a second high tension electrode extending through said insulator body parallel to said central axis; said first high tension electrode having a first lead wire terminal diverging at an acute angle away from said central axis in a first direction; said second high tension electrode having a second lead wire terminal diverging at an acute angle away from said central axis in a second direction; a dielectric boot telescoped onto said shell; said boot having separate dielectric sleeves surrounding said first and second lead wire terminals; a first voltage source connected to said first high tension electrode; and a second voltage source connected to said second high tension electrode, whereby failure of either voltage source will not disable the ignition system.

* * * * *